US008033908B2

(12) United States Patent
Shai-Hee

(10) Patent No.: US 8,033,908 B2
(45) Date of Patent: Oct. 11, 2011

(54) GAMING SYSTEM AND A METHOD OF GAMING

(75) Inventor: Michael A. Shai-Hee, Kingsgrove (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 502 days.

(21) Appl. No.: 12/328,420

(22) Filed: Dec. 4, 2008

(65) Prior Publication Data

US 2009/0176553 A1 Jul. 9, 2009

(30) Foreign Application Priority Data

Dec. 5, 2007 (AU) ..... 2007906650

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS

| | | | | |
|---|---|---|---|---|
| 5,120,068 | A | 6/1992 | Tablan | |
| 5,441,278 | A | 8/1995 | Nalder | |
| D498,504 | S * | 11/2004 | Karstens | D21/370 |
| 7,281,712 | B2 | 10/2007 | Moffett, VI et al. | |
| 7,771,274 | B2 * | 8/2010 | Walker et al. | 463/25 |
| 2004/0229670 | A1 | 11/2004 | Potter et al. | |
| 2005/0187007 | A1 | 8/2005 | Kuroiwa | |
| 2009/0176553 | A1 * | 7/2009 | Shai-Hee | 463/20 |
| 2010/0248808 | A1 * | 9/2010 | Barker et al. | 463/20 |

FOREIGN PATENT DOCUMENTS

| | | |
|---|---|---|
| CA | 2559995 | 12/2006 |
| DE | 3804862 | 10/1988 |
| DE | 3811301 | 10/1989 |
| DE | 19542299 | 5/1997 |
| EP | 1274049 | 1/2003 |
| GB | 190813231 | 6/1909 |
| GB | 1318051 | 5/1973 |
| GB | 1464896 | 2/1977 |
| JP | 2000093595 | 4/2000 |
| JP | 2003062207 | 3/2003 |
| JP | 2003062208 | 3/2003 |
| JP | 2003062209 | 3/2003 |
| JP | 2003062210 | 3/2003 |
| JP | 2003062211 | 3/2003 |
| JP | 2003062212 | 3/2003 |
| JP | 2003062214 | 3/2003 |
| JP | 2006296904 | 11/2006 |
| JP | 2006346068 | 12/2006 |

* cited by examiner

*Primary Examiner* — George Fourson, III
(74) *Attorney, Agent, or Firm* — Hanley, Flight & Zimmerman, LLC

(57) ABSTRACT

A gaming system is disclosed which comprises a display, a symbol selector arranged to select a plurality of symbols for display at a plurality of display positions on the display, and a display modifier arranged to modify the displayed symbols such that after modification of the symbols the locations of the symbols in the display positions are a mirror image of the locations of the symbols before modification of the symbols. The gaming system also comprises an outcome evaluator arranged to determine whether symbol combinations defined by the displayed symbols after modification correspond to one or more winning outcomes. A corresponding method is also disclosed.

30 Claims, 8 Drawing Sheets

GAMING SYSTEM AND A METHOD OF GAMING

CROSS-REFERENCE TO RELATED APPLICATIONS

The present application claims the benefit of priority to Australian Provisional Patent Application No. 2007906650, filed on Dec. 5, 2007, entitled "A GAMING SYSTEM AND A METHOD OF GAMING", which is herein incorporated by reference in its entirety.

FIELD OF THE INVENTION

The present invention relates to a gaming system and to a method of gaming.

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device.

However, while such gaming systems provide users with enjoyment, a need exists for alternative gaming systems in order to maintain or increase player enjoyment.

SUMMARY OF THE INVENTION

In accordance with a first aspect of the present invention, there is provided a gaming system including:

a display;

a symbol selector arranged to select a plurality of symbols for display at a plurality of display positions on the display;

a display modifier arranged to modify the displayed symbols such that after modification of the symbols the locations of the symbols are a mirror image of the locations of the symbols before modification of the symbols; and an outcome evaluator arranged to determine whether symbol combinations defined by the displayed symbols after modification correspond to one or more winning outcomes.

In one embodiment, the gaming system includes a prize allocator arranged to allocate a prize to a player when a symbol combination corresponds to a winning outcome.

In one embodiment, the outcome evaluator is arranged to determine whether symbol combinations defined by the displayed symbols correspond to one or more winning outcomes by reference to a predefined player win entitlement, for example whether the player has purchased one or more win lines, has purchased particular reels, or has purchase particular symbols.

In one embodiment, the display modifier is arranged to modify the displayed symbols such that after modification of the symbols the locations of the symbols are a mirror image of the locations of the symbols before modification of the symbols about a line extending vertically or horizontally of the displayed symbols.

The display modifier may be arranged to modify the displayed symbols such that after modification the symbols are inverted, for example such that the symbols are shown laterally inverted or upside down.

In one embodiment, the outcome evaluator is arranged to determine whether symbol combinations defined by the displayed symbols correspond to one or more winning outcomes both before and after modification of the displayed symbols, and the prize allocator is arranged to allocate a prize to a player when a symbol combination corresponds to a winning outcome before and/or after modification of the symbols.

At least one set of symbols may include at least one function symbol having an associated function which may be a wild function, a scatter function, a multiplier function, a repeat win function or a jackpot function.

In one embodiment, the gaming system is arranged to operate in normal game mode and special game mode, and the display modifier is arranged to modify the displayed symbols only when the gaming system operates in special game mode.

The gaming system may be arranged to commence special game mode when a predetermined game outcome occurs, on the basis of a game event occurring during a game such as display of a particular symbol, in response to player input, based on the amount or type of bet placed, when a special game is purchased by a player, based on a gaming machine event or other gaming system event.

The gaming system may be implemented as a stand alone gaming machine or across a network.

In accordance with a second aspect of the present invention, there is provided a method of gaming including:

selecting a plurality of symbols for display at a plurality of display positions;

modifying the displayed symbols such that after modification of the symbols the locations of the symbols are a mirror image of the locations of the symbols before modification of the symbols; and determining whether symbol combinations defined by the displayed symbols after modification correspond to one or more winning outcomes.

In accordance with a third aspect of the present invention, there is provided a computer program arranged when loaded into a computer to instruct the computer to operate in accordance with a gaming system including:

a symbol selector arranged to select a plurality of symbols for display at a plurality of display positions on the display;

a display modifier arranged to modify the displayed symbols such that after modification of the symbols the locations of the symbols are a mirror image of the locations of the symbols before modification of the symbols; and an outcome evaluator arranged to determine whether symbol combinations defined by the displayed symbols after modification correspond to one or more winning outcomes.

In accordance with a fourth aspect of the present invention, there is provided a computer readable medium having computer readable program code embodied therein for causing a computer to operate in accordance with a gaming system including:

a symbol selector arranged to select a plurality of symbols for display at a plurality of display positions on the display;

a display modifier arranged to modify the displayed symbols such that after modification of the symbols the locations of the symbols are a mirror image of the locations of the symbols before modification of the symbols; and an outcome evaluator arranged to determine whether symbol combinations defined by the displayed symbols after modification correspond to one or more winning outcomes.

In accordance with a fifth aspect of the present invention, there is provided a data signal having computer readable program code embodied therein for causing a computer to operate in accordance with a gaming system including:

a symbol selector arranged to select a plurality of symbols for display at a plurality of display positions on the display;

a display modifier arranged to modify the displayed symbols such that after modification of the symbols the locations of the symbols are a mirror image of the locations of the symbols before modification of the symbols; and an outcome evaluator arranged to determine whether symbol combinations defined by the displayed symbols after modification correspond to one or more winning outcomes.

BRIEF DESCRIPTION OF THE DRAWINGS

Certain embodiments of the present invention will now be described, by way of example only, with reference to the accompanying drawings, in which.

Figure 1:
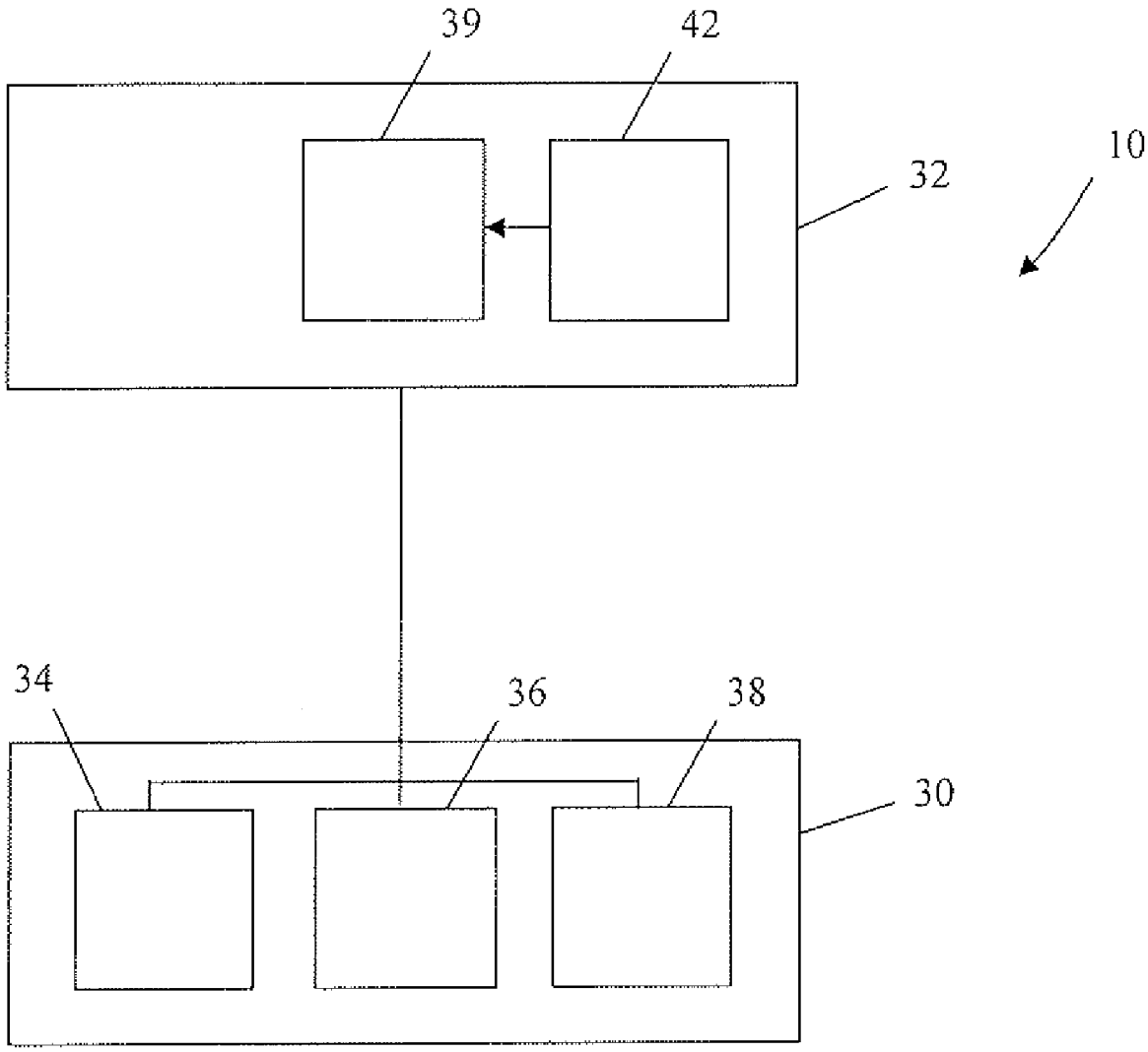
FIG. 1 is a schematic block diagram of core components of a gaming system in accordance with an embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DESCRIPTION OF CERTAIN EMBODIMENTS OF THE INVENTION

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. With some such probabilistic games, the set of symbols include standard symbols and function symbols, and the game outcome is determined on the basis of the displayed standard symbols and the function associated with any displayed function symbol, based on a displayed specific pattern of symbols, or in any other way. For example, standard symbols may resemble fruit such as apples, pears and bananas with a win outcome being determined when a predetermined number of the same fruit appear on a display in the same line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

The present gaming system operates such that winning combinations are determined on the basis of symbols appearing at display positions after symbol selection, and at least during a portion of a game implemented by the gaming system, on the basis of symbols appearing at display positions after application of a display modification operation to the displayed symbols which causes the displayed symbols to move. The movement is such that the new locations of the symbols are a mirror image of the locations of the symbols before movement. In this way, the likelihood of a player achieving a winning outcome increases whilst maintaining the same win entitlements, such as win lines, which have been purchased or otherwise obtained for the game. This in turn enables a player cognisant of the available win entitlements for the game, such as the available win line(s), to determine whether a win outcome has occurred without difficulty.

It will be understood that win outcomes may be determined on the basis of win entitlements which are predefined, or selected and in some embodiments purchased by a player, or selected according to game rules. Such selected win entitlements may include win lines, reels or symbols which are purchased by a player in order that the win lines, reels or symbols may for the basis of evaluating win outcomes.

Referring to FIG. 1, a schematic diagram of core components of a gaming system 10 is shown. The core components include a player interface 30 and a game controller 32. The player interface 30 is arranged to enable interaction between a player and the gaming system and for this purpose includes input/output components for the player to enter instructions and play the game.

Components of the player interface 30 may vary but will typically include a credit mechanism 34 to enable a player to input credits and receive payouts, one or more displays 36 which may include a touch screen, and a game play mechanism 38 arranged to enable a player to input game play instructions.

The game controller 32 is in data communication with the player interface 30 and typically includes a processor 39 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or any other computational device such as a personal computer or a server.

Figure 2:
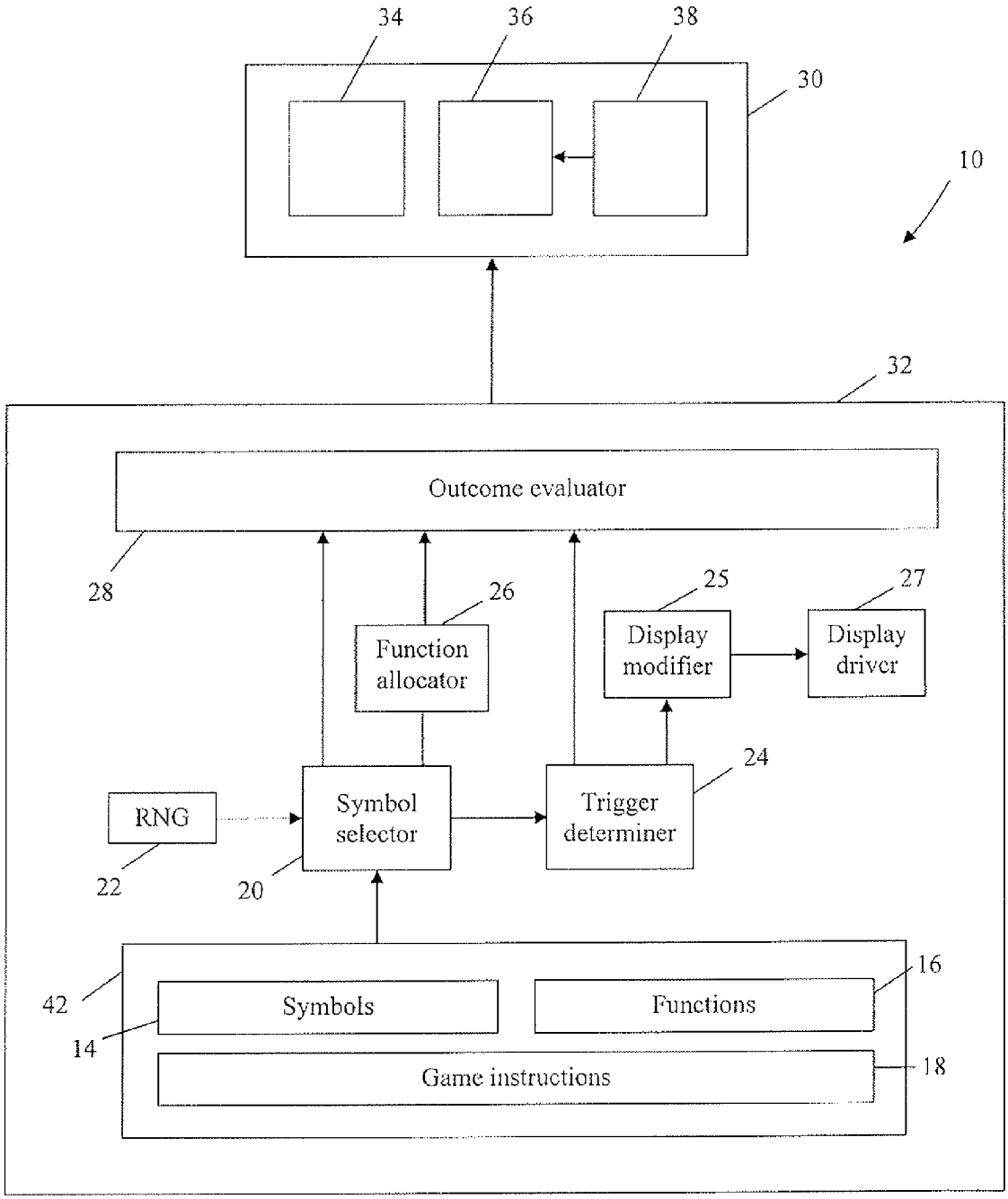
FIG. 2 is a schematic block diagram of functional components of a gaming system in accordance with an embodiment of the present invention.

A functional diagram illustrating operative components of the game controller 32 is shown in FIG. 2.

The memory 42 is arranged to store symbols data 14 indicative of a plurality of symbols, in the present example associated with a plurality of reels, function data 16 indicative of one or more functions allocatable to the symbols, and game instruction data 18 indicative of game instructions usable by the gaming machine 10 to control operation of the game.

The game controller 32 includes a symbol selector 20 which is arranged to select several symbols from the available symbols for display to a player in a plurality of display positions, in this example by spinning reels containing the symbols and stopping the reels so as to display at least one symbol on each reel. In this example, the selection carried out by the symbol selector 20 is made using a random number generator 22.

It will be appreciated that the random number generator 22 may be of a type which is arranged to generate pseudo random numbers based on a seed number, and that in this specification the term "random" will be understood accordingly to mean truly random or pseudo random.

With this embodiment, the game controller 32 also includes a trigger determiner 24 arranged to determine whether a trigger condition exists and to commence special game mode when a trigger condition has been detected. Such a trigger condition may be display of a particular symbol or combination of symbols.

The trigger determiner 24 communicates with a display modifier 25 arranged to control a display driver 27 to move displayed symbols when a trigger condition occurs such that the new display positions are a mirror image of the previous display positions. In this way, the displayed symbols appear to flip, for example about a horizontal line passing through the central line of symbols, or about a vertical line passing through a third reel of a five reel configuration.

In this example, the game controller 32 also includes a function allocator 26 arranged to select and allocate one or more functions to one or more symbols. Such functions include a wild function, a scatter function, or any other function which may be applied to a symbol or to the game.

The game controller 32 also includes an outcome evaluator 28 which in accordance with the game instructions 18 determines game outcomes based on the symbols selected for display to the player by the symbol selector 20, and during special game mode based on the symbols displayed after the displayed symbols have been flipped about a horizontal or vertical line.

In the embodiments described below, the symbol selector 20, the trigger determiner 24, the display modifier 25, the function allocator 26, and the outcome evaluator 28 are at least partly implemented using the processor 39 and associated software, although it will be understood that other implementations are envisaged.

The gaming system 10 can take a number of different forms.

In a first form, a stand alone gaming machine is provided wherein all or most components for implementing the game are present in a player operable gaming machine.

In a second form, a distributed architecture is provided wherein some of the components for implementing the game are present in a player operable gaming machine and some of the components for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 3:
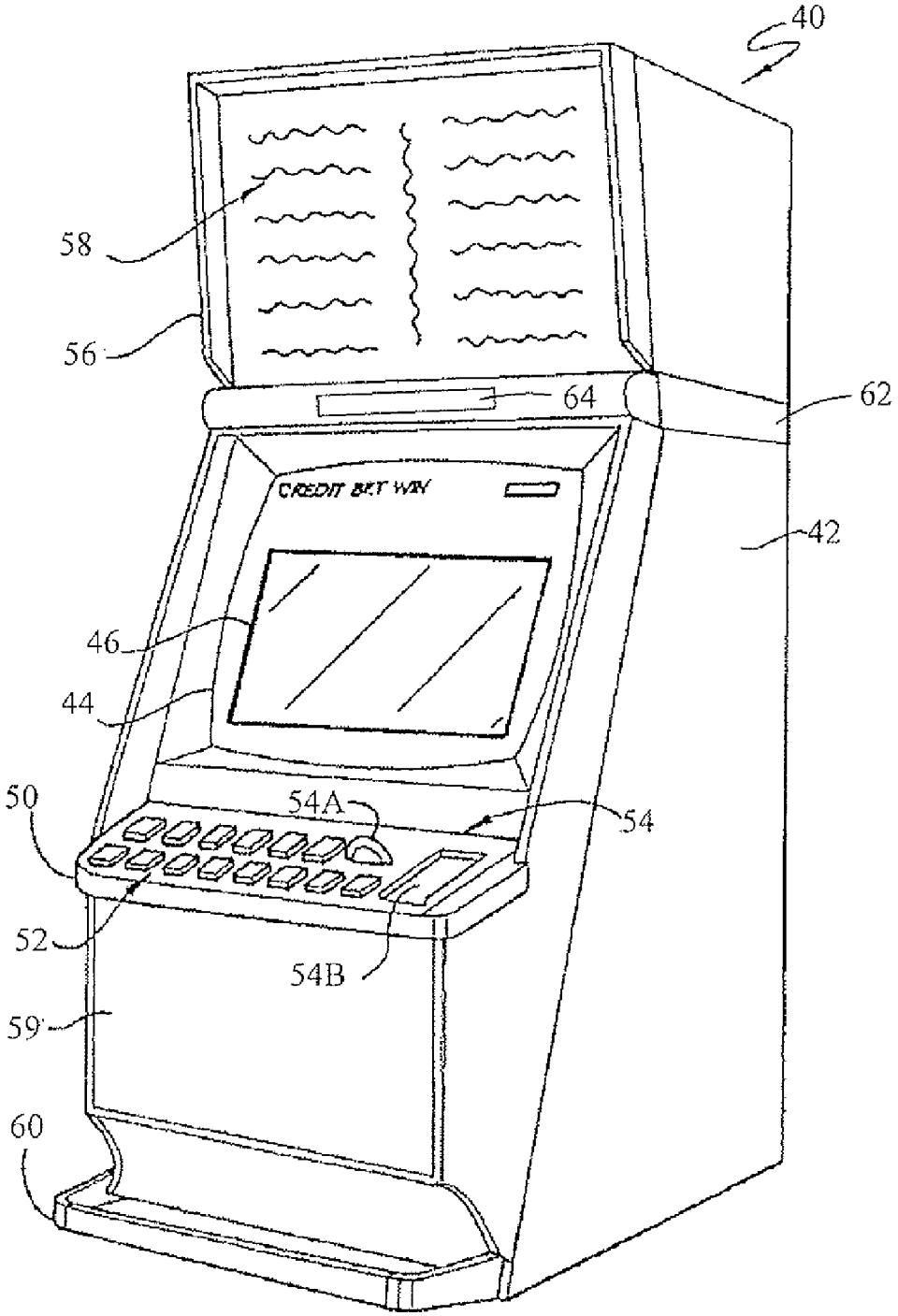
FIG. 3 is a diagrammatic representation of a gaming system in accordance with an embodiment of the present invention with the gaming system implemented in the form of a stand alone gaming machine.

A gaming system in the form of a stand alone gaming machine 40 is illustrated in FIG. 3. The gaming machine 40 includes a console 42 having a display 44 on which is displayed representations of a game 46 that can be played by a player. A mid-trim 50 of the gaming machine 40 houses a bank of buttons 52 for enabling a player to interact with the gaming machine, in particular during gameplay. The mid-trim 50 also houses a credit input mechanism 54 which in this example includes a coin input chute 54A and a bill collector 54B. Other credit input mechanisms may also be employed, for example, a card reader for reading a smart card, debit card or credit card.

A top box 56 may carry artwork 58, including for example pay tables and details of bonus awards and other information or images relating to the game. Further artwork and/or information may be provided on a front panel 59 of the console 42. A coin tray 60 is mounted beneath the front panel 59 for dispensing cash payouts from the gaming machine 40.

The display 44 is in the form of a video display unit, particularly a cathode ray tube screen device. Alternatively, the display 44 may be a liquid crystal display, plasma screen, or any other suitable video display unit. The top box 56 may also include a display, for example a video display unit, which may be of the same type as the display 44, or of a different type. The display 44 may include a touch screen usable by a player to interact with the gaming machine, in particular during game play.

The display 44 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols.

A player marketing module (PMM) 62 having a display 64 is connected to the gaming machine 10. The main purpose of the PMM 62 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

Figure 4:
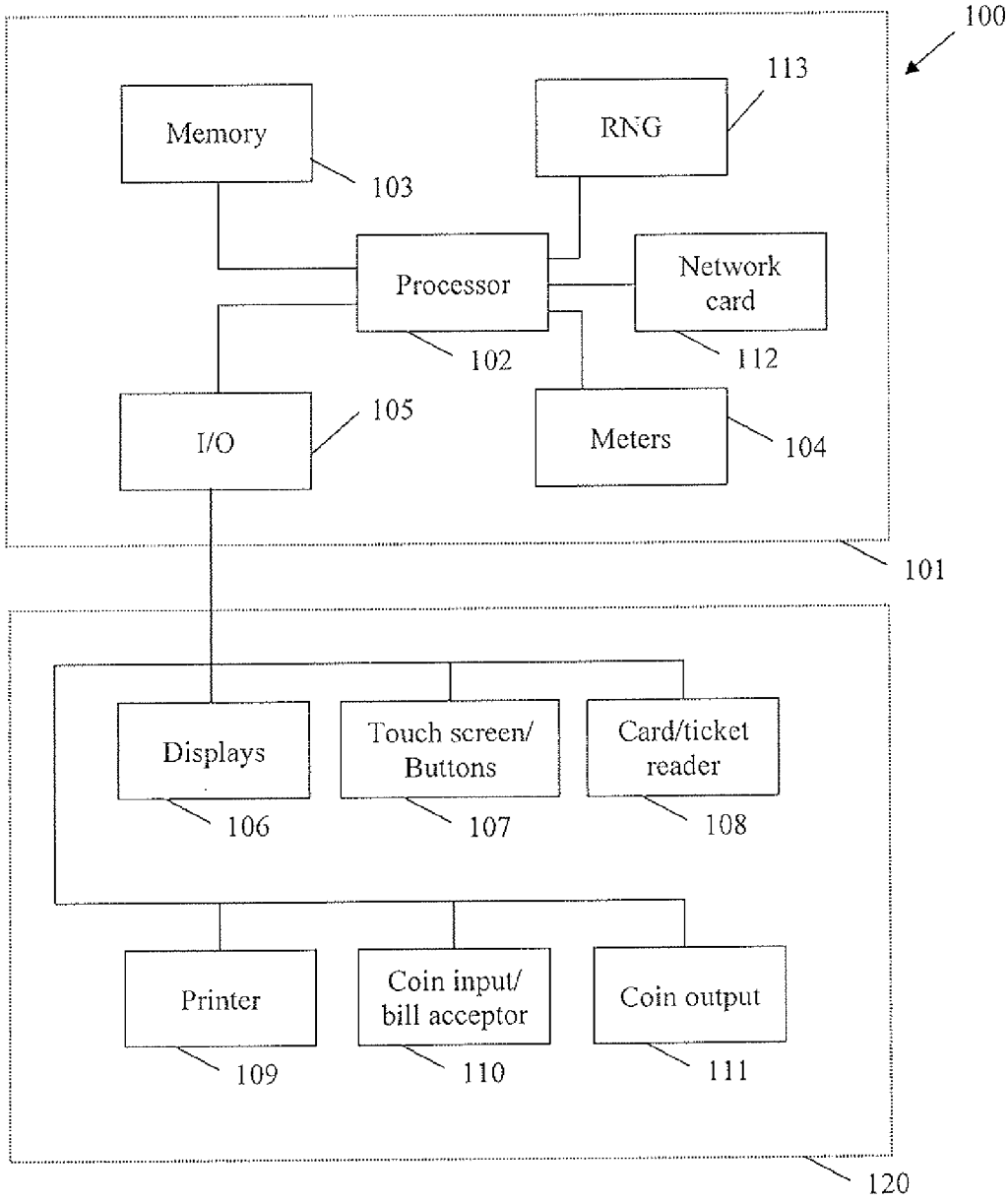
FIG. 4 is a schematic block diagram of operative components of the gaming machine shown in FIG. 3.

FIG. 4 shows a block diagram of operative components of a gaming machine 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
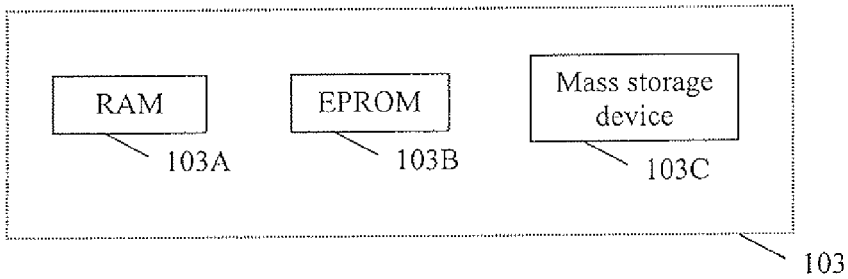
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 include one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted based on the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106,107,108,109,110,111 may be provided remotely from the game controller 101.

Figure 6:
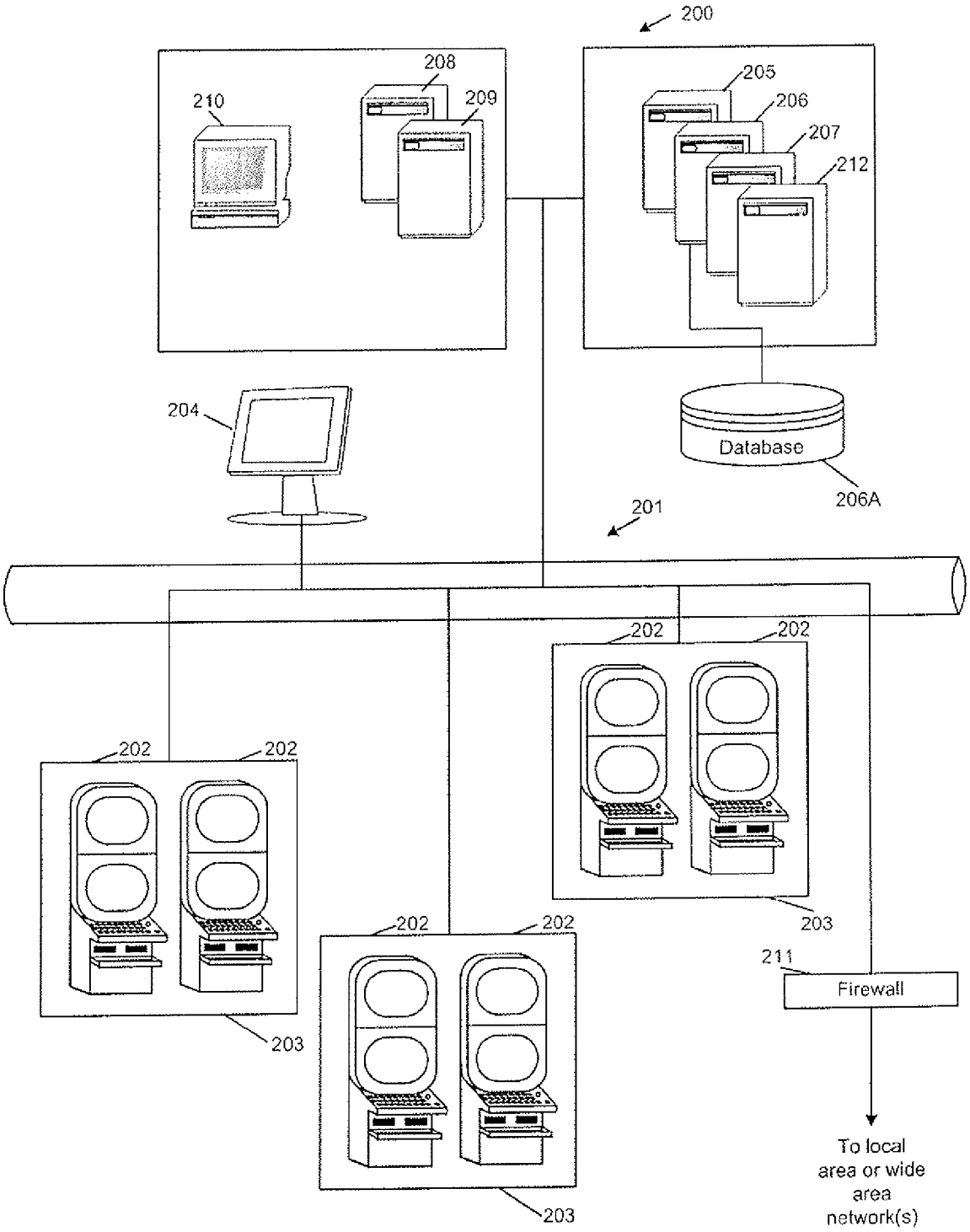
FIG. 6 is a schematic diagram of a gaming system in accordance with an alternative embodiment of the present invention with the gaming system implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40,100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

The gaming system 200 may also include a loyalty program server 212.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a stand alone gaming machine 10, 40, 100 or over a network 201, implements a probabilistic game wherein at least during part of the game the gaming system modifies the positions of displayed symbols such that the symbols appear to have been flipped about a horizontal or vertical line, and game outcomes are determined on the basis of symbol combinations displayed before and after modification of the displayed symbol positions.

Examples of specific implementations of the gaming system will now be described in relation to a stand alone gaming machine 10, 40, 100 although it will be understood that implementation may also be carried out using other gaming system architectures such as a network architecture of the type shown in FIG. 6.

In this example, the gaming system is operable in normal game mode and special game mode and the gaming system includes five reels, each of which has an associated set of symbols.

During normal game mode, the reels include standard symbols and optionally one or more function symbols and win outcomes are determined on the basis of the symbols visible at the display positions when the reels stop rotating.

Typically, a player will purchase or otherwise obtain win entitlements such as several win lines which are used in the game to determine win outcomes. If the displayed symbols on the reels include symbols associated with a winning combination such as disposed on a win line, the player wins a prize.

During special game mode, the gaming system modifies the positions of displayed symbols, for example such that the symbols appear to have been flipped about a horizontal or vertical line. If the displayed symbols on the reels have symbols associated with a winning combination such as disposed on a win line after modification of the displayed symbol positions, the player wins a prize.

The gaming system may be arranged to commence special game mode when a predetermined game outcome occurs, and special game mode may include one or more free games. Special game mode may commence automatically on the basis of a game event occurring during a game such as display of a particular symbol, based on game outcomes determined by the gaming system, or may be prompted by a player pressing a button on the gaming system 10, 40, 100 after the player has identified that a game outcome corresponding to special game mode requirements has occurred.

The gaming system 10, 40, 100 may also be arranged so as to determine eligibility for special game mode, for example based on the amount or type of bet placed, based on certain time periods and so on.

Special game mode may also be arranged to commence when a special game is purchased by a player.

Figure 7:
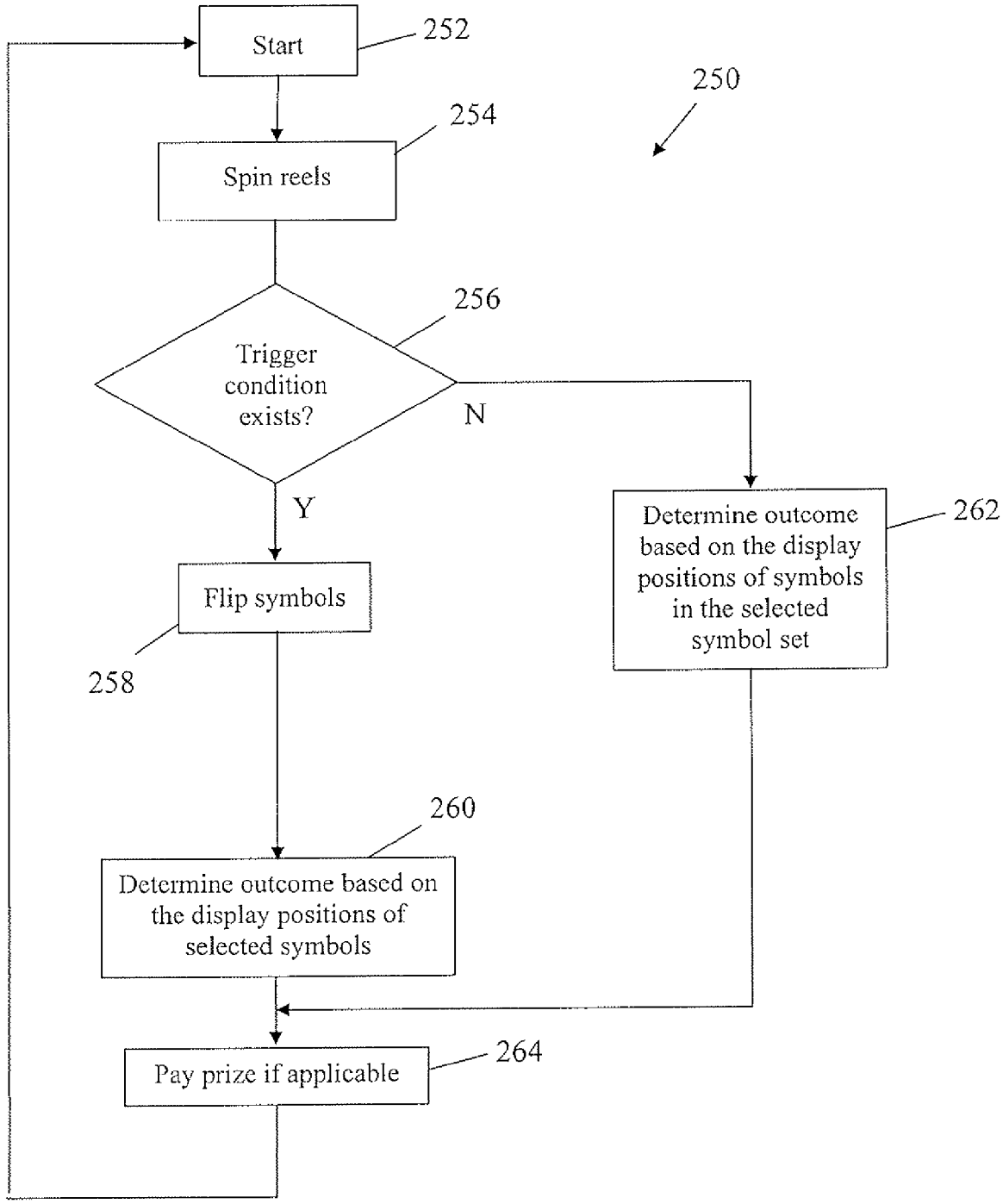
FIG. 7 is a flow diagram illustrating game play of a gaming system in accordance with an embodiment of the present invention.

A specific example will now be described in relation to flow diagram 250 shown in FIG. 7 which illustrates steps 252 to 264 of a method of gaming implemented by the gaming system according to the present embodiment.

In this example, five reels R1, R2, R3, R4, R5 are provided. The reels are virtual reels and, as such, representations of the reels are displayed on a graphical display device 44.

During normal game mode, the reels R1 to R5 are spun and subsequently stopped to display a symbol 290 at each display position 240. An example screen representation 300 shown on the display device 44 is shown in FIG. 8*a*.

The outcome evaluator 28 determines whether the symbols 290 displayed at the display positions 240 correspond to a winning outcome by reference to the win lines available for the game.

Figure 8A:
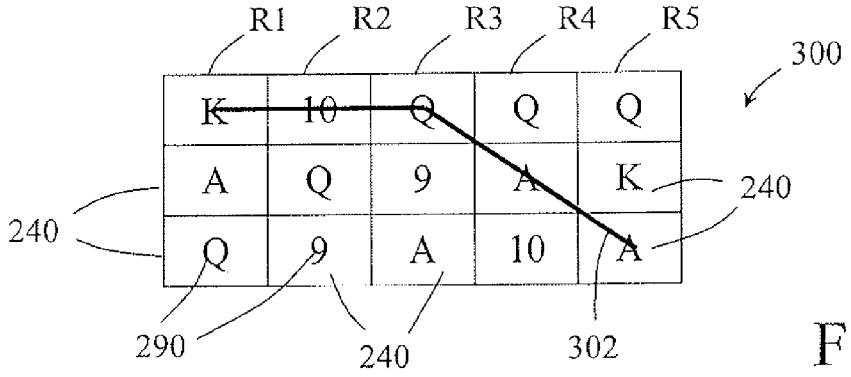
FIGS. 8*a* and 8*b* are diagrammatic representations of example symbols displayed by a gaming system in accordance with an embodiment of the present invention during implementation of a game.

As shown in FIG. 8*a*, in the present example the displayed symbols do not correspond to a winning outcome since a winning combination of symbols is not present on any of the win lines available for the game. In particular, although a QUEEN symbol is displayed on each of the reels, the combination of QUEEN symbols displayed does not correspond to an available win line 302.

Figure 8B:
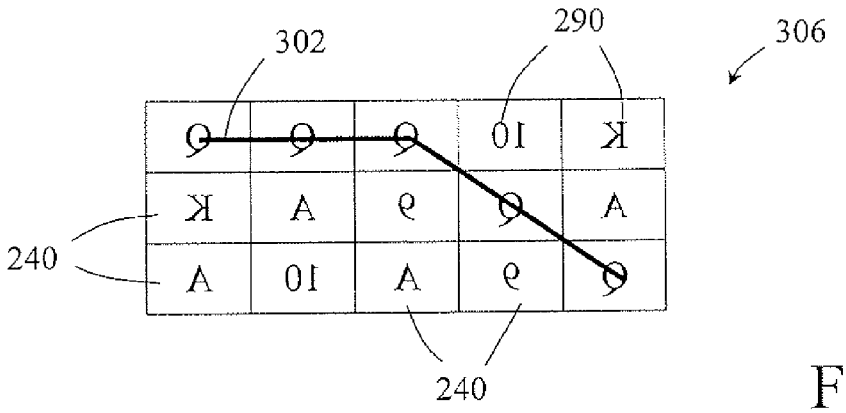

After commencement of special game mode, the positions of the displayed symbols are modified so as to provide the appearance that the displayed symbols have been flipped about a vertical line passing through the third reel R3, and a screen representation 306 including the symbols displayed after modification is shown in FIG. 8*b*. It will be understood that operation is such that the symbols are flipped and not the win line.

An example win line 302, in this example purchased by a player, is shown in FIGS. 8*a* and 8*b* and it will be understood that before modification of the symbol positions, the win line 302 does not correspond to a winning outcome. However, after modification of the symbol positions, five QUEEN symbols are present along the win line 302 which corresponds to a winning outcome.

In this example, in order to enhance the appearance that the symbols have been flipped, the symbols may be laterally inverted as shown in FIG. 8*b*.

Figure 9A:
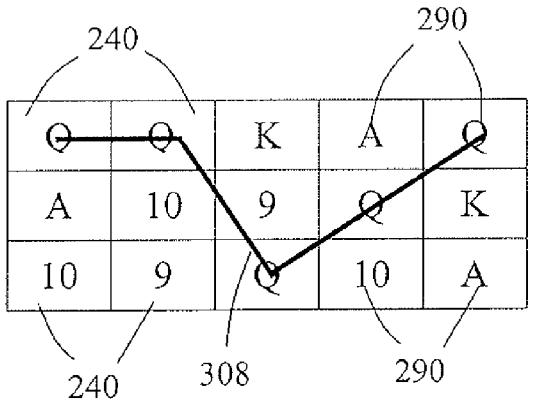
FIGS. 9*a* and 9*b* are diagrammatic representations of further example symbols displayed by a gaming system in accordance with an embodiment of the present invention during implementation of a game.
Figure 9B:
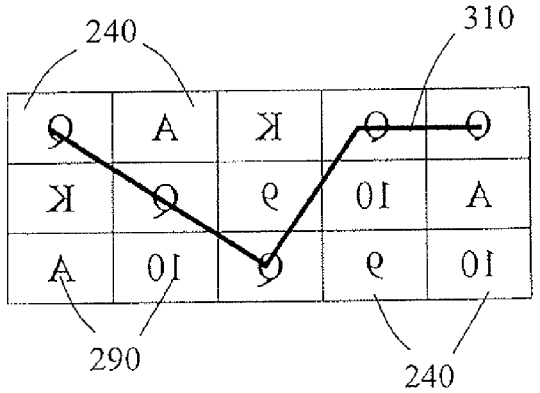

A further example is shown in FIGS. 9*a* and 9*b* with two different available win lines 308, 310 indicated. As with the example described in relation to FIGS. 8*a* and 8*b*, the displayed symbols have been flipped about a vertical line passing through the third reel R3. However, with this example, it will be understood that a win outcome exists both before and after modification of the symbol positions. In this situation, the gaming system may be arranged to allocate a prize to a player for both outcomes.

Figure 10A:
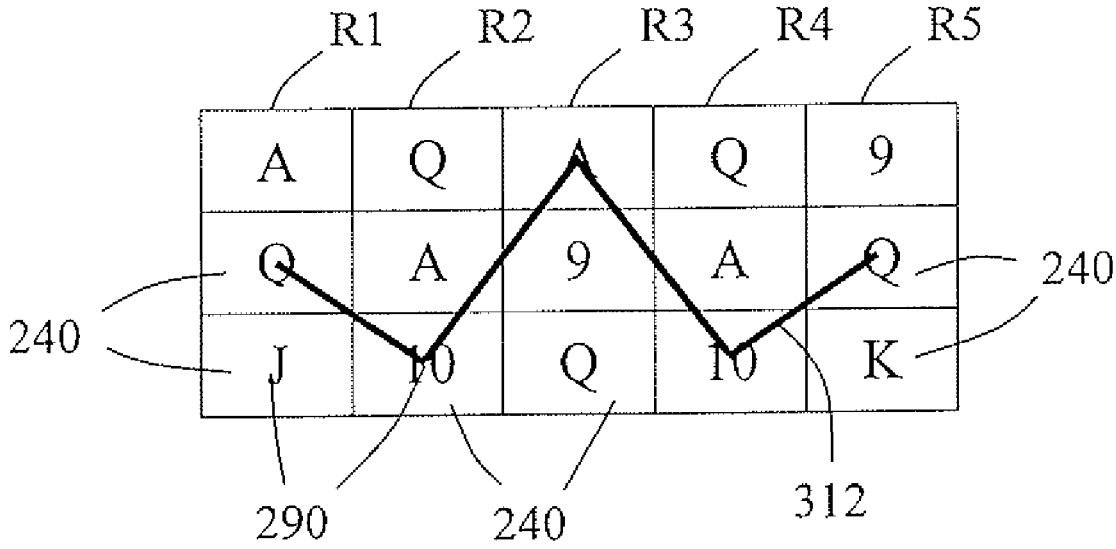
FIGS. 10*a* and 10*b* are diagrammatic representations of further example symbols displayed by a gaming system in accordance with an embodiment of the present invention during implementation of a game.
Figure 10B:
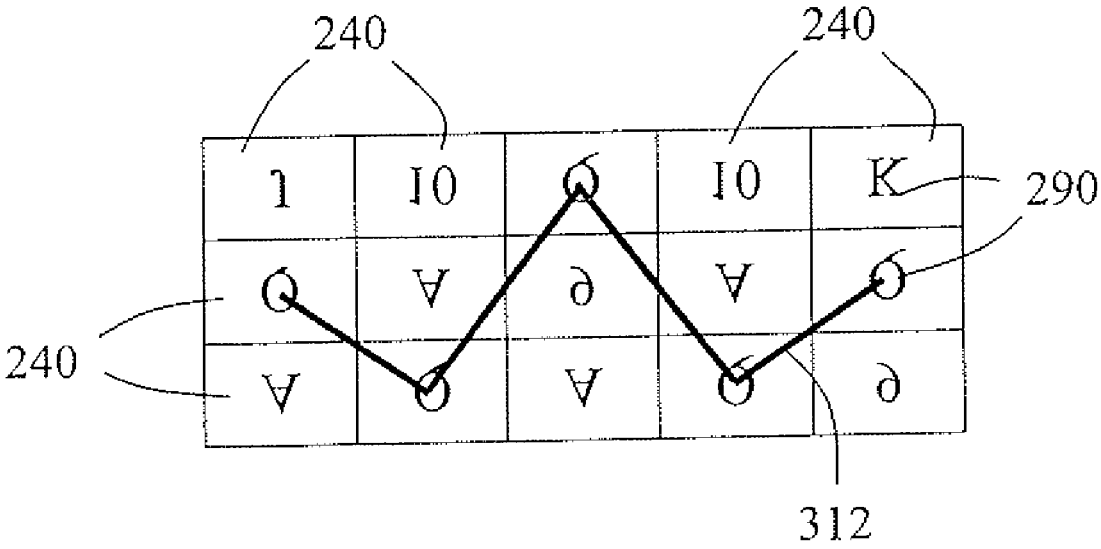

A further example is shown in FIGS. 10*a* and 10*b*. In this example, during special game mode the displayed symbols have been flipped about a horizontal line passing through the central positions on the reels R1, R2, R3, R4, R5. An example win line 312 purchased by a player is shown in FIGS. 10*a* and 10*b* and it will be understood that before modification of the symbol positions, the win line 312 does not correspond to a winning outcome. However, after modification of the symbol positions, five QUEEN symbols are present along the win line 302 which corresponds to a winning outcome.

In this example, in order to enhance the appearance that the symbols have been flipped, the symbols may be shown upside down as shown in FIG. 10*b*

Modifications and variations as would be apparent to a skilled addressee are deemed to be within the scope of the present invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Method steps associated with certain embodiments may be implemented in one embodiment by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

The invention claimed is:

1. A gaming system comprising:

a display;

a symbol selector arranged to select a plurality of symbols for display at a plurality of display positions on the display;

a display modifier arranged to modify the displayed symbols such that after modification of the symbols the locations of the symbols in the display positions are a mirror image of the locations of the symbols before modification of the symbols; and an outcome evaluator arranged to determine whether symbol combinations defined by the displayed symbols after modification correspond to one or more winning outcomes.

2. A gaming system as claimed in claim 1, comprising a prize allocator arranged to allocate a prize to a player when a symbol combination corresponds to a winning outcome.

3. A gaming system as claimed in claim 1, wherein the outcome evaluator is arranged to determine whether symbol combinations defined by the displayed symbols correspond to one or more winning outcomes by reference to a player win entitlement.

4. A gaming system as claimed in claim 3, wherein the win entitlement is dependent on whether a player has purchased one or more win lines, has purchased particular reels, or has purchased particular symbols.

5. A gaming system as claimed in claim 1, wherein the display modifier is arranged to modify the displayed symbols such that after modification of the symbols the locations of the symbols are a mirror image of the locations of the symbols before modification of the symbols about a line extending vertically of the displayed symbols.

6. A gaming system as claimed in claim 1, wherein the display modifier is arranged to modify the displayed symbols such that after modification of the symbols the locations of the symbols are a mirror image of the locations of the symbols before modification of the symbols about a line extending horizontally of the displayed symbols.

7. A gaming system as claimed in claim 1, wherein the display modifier is arranged to modify the displayed symbols such that after modification the symbols are inverted.

8. A gaming system as claimed in claim 7, wherein the display modifier is arranged to modify the displayed symbols such that after modification the symbols are shown laterally inverted.

9. A gaming system as claimed in claim 7, wherein the display modifier is arranged to modify the displayed symbols such that after modification the symbols are shown upside down.

10. A gaming system as claimed in claim 1, wherein the outcome evaluator is arranged to determine whether symbol combinations defined by the displayed symbols correspond to one or more winning outcomes both before and after modification of the displayed symbols, and the prize allocator is arranged to allocate a prize to a player when a symbol combination corresponds to a winning outcome before and/or after modification of the symbols.

11. A gaming system as claimed in claim 1, wherein at least one set of symbols includes at least one function symbol having an associated function.

12. A gaming system as claimed in claim 11, wherein the function is a wild function, a scatter function, a multiplier function, a repeat win function or a jackpot function.

13. A gaming system as claimed in claim 1, wherein the gaming system is arranged to operate in normal game mode and special game mode, and the display modifier is arranged to modify the displayed symbols only when the gaming system operates in special game mode.

14. A gaming system as claimed in claim 13, wherein the gaming system is arranged to commence special game mode when a predetermined game outcome occurs, on the basis of a game event occurring during a game, in response to player input, based on the amount or type of bet placed, or when a special game is purchased by a player.

15. A gaming system as claimed in claim 1, wherein the gaming system is implemented as a stand alone gaming machine or across a network.

16. A method of gaming comprising:

selecting a plurality of symbols for display at a plurality of display positions;

modifying the displayed symbols such that after modification of the symbols the locations of the symbols in the display positions are a mirror image of the locations of the symbols before modification of the symbols; and determining whether symbol combinations defined by the displayed symbols after modification correspond to one or more winning outcomes.

17. A method as claimed in claim 16, comprising allocating a prize to a player when a symbol combination corresponds to a winning outcome.

18. A method as claimed in claim 16, comprising determining whether symbol combinations defined by the displayed symbols correspond to one or more winning outcomes by reference to a player win entitlement.

19. A method as claimed in claim 18, wherein the win entitlement is dependent on whether a player has purchased one or more win lines, has purchased particular reels, or has purchased particular symbols.

20. A method as claimed in claim 16, comprising modifying the displayed symbols such that after modification of the symbols the locations of the symbols are a mirror image of the locations of the symbols before modification of the symbols about a line extending vertically of the displayed symbols.

21. A method as claimed in claim 16, comprising modifying the displayed symbols such that after modification of the symbols the locations of the symbols are a mirror image of the locations of the symbols before modification of the symbols about a line extending horizontally of the displayed symbols.

22. A method as claimed in claim 16, comprising modifying the displayed symbols such that after modification the symbols are inverted.

23. A method as claimed in claim 22, comprising modifying the displayed symbols such that after modification the symbols are shown laterally inverted.

24. A method as claimed in claim 22, comprising modifying the displayed symbols such that after modification the symbols are shown upside down.

25. A method as claimed in claim 16, comprising determining whether symbol combinations defined by the displayed symbols correspond to one or more winning outcomes both before and after modification of the displayed symbols.

26. A method as claimed in claim 16, comprising allocating a function to at least one symbol.

27. A method as claimed in claim 26, wherein the function is a wild function, a scatter function, a multiplier function, a repeat win function or a jackpot function.

28. A method as claimed in claim 16, comprising providing normal game mode and special game mode, and modifying the displayed symbols only when the method operates in special game mode.

29. A method as claimed in claim 28, comprising commencing special game mode when a predetermined game outcome occurs, on the basis of a game event occurring during a game, in response to player input, based on the amount or type of bet placed, or when a special game is purchased by a player.

30. A computer readable medium having computer readable program code embodied therein for causing a computer to operate in accordance with a gaming system comprising:

a display;

a symbol selector arranged to select a plurality of symbols for display at a plurality of display positions on the display;

a display modifier arranged to modify the displayed symbols such that after modification of the symbols the locations of the symbols in the display positions are a mirror image of the locations of the symbols before modification of the symbols; and an outcome evaluator arranged to determine whether symbol combinations defined by the displayed symbols after modification correspond to one or more winning outcomes.

* * * * *